US005344247A

United States Patent [19]

Sakuragi et al.

[11] Patent Number: 5,344,247

[45] Date of Patent: Sep. 6, 1994

[54] PRINTING DEVICE

[75] Inventors: Shoji Sakuragi; Akihiro Sawada; Hideo Ueno, all of Nagoya, Japan

[73] Assignee: Brother Kogyo Kabushiki Kaisha, Aichi, Japan

[21] Appl. No.: 20,282

[22] Filed: Feb. 19, 1993

[30] Foreign Application Priority Data

Feb. 21, 1992 [JP] Japan ..... 4-72566

[51] Int. Cl.[5] ..... B41J 11/42

[52] U.S. Cl. ..... 400/582; 400/61; 400/615.2; 395/102; 395/137

[58] Field of Search ..... 400/120, 61, 64, 76, 400/54, 712, 582, 583; 340/727; 395/102, 137, 115, 116

[56] References Cited

U.S. PATENT DOCUMENTS

| | | | |
|---|---|---|---|
| 4,729,107 | 3/1988 | Hasegawa et al. | 340/727 |
| 4,741,635 | 5/1988 | Shibata | 400/61 |
| 4,796,201 | 1/1989 | Wake | 346/727 |
| 4,937,761 | 6/1990 | Hassett | 340/727 |
| 5,012,434 | 4/1991 | Zietlow et al. | 340/727 |
| 5,071,273 | 12/1991 | Kato | 400/582 |
| 5,174,668 | 12/1992 | Sakamoto et al. | 400/582 |
| 5,222,818 | 6/1993 | Akiyama et al. | 400/61 |

FOREIGN PATENT DOCUMENTS

| | | | |
|---|---|---|---|
| 0147441 | 12/1978 | Japan | 340/727 |
| 0109658 | 5/1987 | Japan | 340/727 |
| 0172665 | 7/1988 | Japan | 340/727 |
| 0660066 | 4/1979 | U.S.S.R. | 340/727 |

*Primary Examiner*—Eugene H. Eickholt
*Attorney, Agent, or Firm*—Kane, Dalsimer, Sullivan, Kurucz, Levy, Eisele and Richard

[57] ABSTRACT

A printing device, which is capable of printing image onto a tape-type recording medium along the longitudinal direction of the tape-type recording medium, is also capable of printing the image on the tape-type recording medium in a rotated fashion with respect to the longitudinal direction of the tape-type recording medium. When the image is printed with a certain rotation, it is discriminated whether a length of the image to be printed in the rotated fashion in the width direction of the tape-type recording medium is smaller than the width of the tape-type recording medium. Then the size of the image to be printed is reduced if the length of the image is greater than or equal to the width of the tape-type recording medium. It is further discriminated whether the length, in the width direction of the tape-type recording medium, of the image to be printed after reduced by the reducing means is smaller than the width of the tape-type recording medium; and alarm is actuated if the length of the reduced image is still greater than or equal to the width of the tape-type recording medium.

16 Claims, 6 Drawing Sheets

PRINTING DEVICE

BACKGROUND OF THE INVENTION

The present invention relates to a printing device capable of printing images such as letters, characters and the like onto the surface of a tape-type recording medium along the longitudinal direction of the tape.

Conventionally, there is proposed a printing device for creating a tape by printing mirror images of characters and the like on the backside of a transparent tape and adhering a double-sided adhesive tape provided with a release paper thereon. The tape created as above can be suitably used for an index and the like as it is adhered to the backside of a video cassette and the like.

Incidentally, in this kind of the printing device, printing is usually carried out in a lateral direction (along the longitudinal direction of a tape). In other words, a character string is printed along the feeding direction of the tape. Hereinafter, such printing is referred to as lateral printing. On the other hand, there exists a printing device with which each character of the character string is printed with a 90-degree rotation as shown in FIG. 8.

An example of a printing device capable of selectively performing lateral printing and the printing as shown in FIG. 8 is disclosed in Japanese Patent Application No. HEI 3-230935, teachings of which are hereby incorporated by reference.

As shown in FIG. 9, however, there is a further desire to print character strings (a train of characters) with 90-degree or 270-degree rotation on the surface of a tape.

In such a case, characters cannot be printed within the width of a tape if the character string is longer than the width of the tape as shown in FIG. 9.

SUMMARY OF THE INVENTION

It is therefore an object of the present invention to provide an improved printing device capable of printing a character string in a rotated manner even if the length of the character string is relatively long.

For the above object, according to the present invention, there is provided a printing device capable of printing images onto a tape-type recording medium along the longitudinal direction of the tape-type recording medium, comprising:

means for printing the image on the tape-type recording medium in a rotated fashion with respect to the longitudinal direction; and means for reducing the size of the image to be printed on the tape-type recording medium in the rotated fashion.

Optionally, the printing device is capable of printing the image with a 90-degree or 270-degree rotation.

Further, the image to be printed could be a character string having a plurality of characters.

Furthermore, the image includes a plurality of lines of character strings each having a plurality of characters.

According to another aspect of the invention, there is provided a printing device capable of printing images onto a tape-type recording medium along the longitudinal direction of the tape-type recording medium, comprising:

means for printing the image on the tape-type recording medium in a rotated fashion with respect to the longitudinal direction of the tape-type recording medium;

means for determining whether the length of the image to be printed in the rotated fashion across the width direction of the tape-type recording medium is smaller than the width of the tape-type recording medium; and means for reducing the size of the image if it is discriminated that the length of the image is greater than or equal to the width of the tape-type recording medium.

Optionally, the printing means prints the image without reducing the size thereof if it is discriminated that the length of the image is smaller than the width of the tape-type recording medium.

Further, the image includes a character strings having a plurality of characters. The image can include a plurality of lines of character string each having a plurality of characters.

Further optionally, the printing device further comprises:

second determining means for determining whether the length, in the width direction of the tape-type recording medium, of the image to be printed after reduction by the reducing means is smaller than the width of the tape-type recording medium; and alarm means actuated if it is discriminated that the length of the reduced image is greater than or equal to the width of the tape-type recording medium.

The printing operation is prohibited when it is discriminated that the length of the reduced image is greater than or equal to the width of the tape-type recording medium.

DESCRIPTION OF THE ACCOMPANYING DRAWINGS

DESCRIPTION OF THE EMBODIMENT

Figure 1:
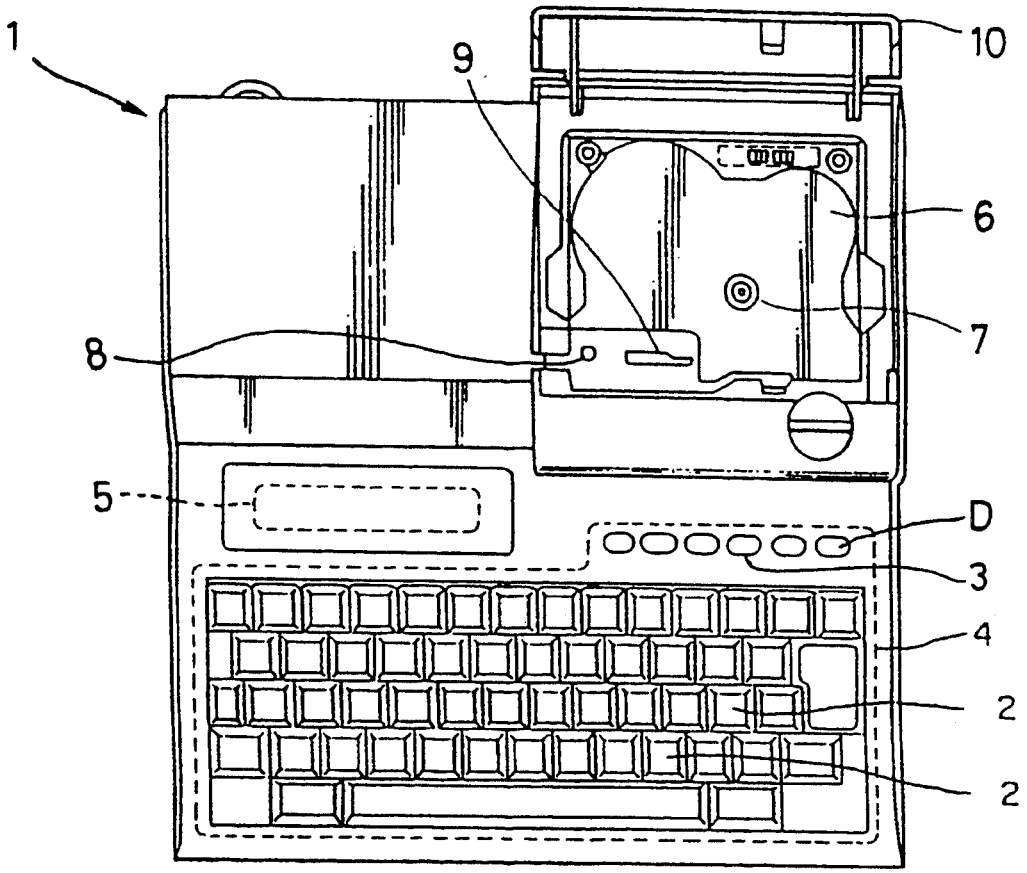
FIG. 1 is a plan view of a printing device embodying the present invention.

FIG. 1 shows a plan view of a printing device 1 embodying the present invention. The printing device 1 includes a keyboard 4 provided with character input keys 2 for inputting letters and the like, print keys 3, a direct print selection key D, and other various function keys. Further, the printing device 1 is provided with a liquid crystal display 5 for displaying letters and the like inputted through the keyboard 4, and a cassette accommodation unit 6 for accommodating a tape cassette 20, which will be described later. The above character input keys 2 and function keys are operated for creating text, and hereinafter they are referred to as text creation keys.

The cassette accommodation unit 6 is provided with a ribbon winding shaft 7 vertically arranged therein. The ribbon winding shaft 7 is driven to rotate by a pulse motor 45. As the ribbon winding shaft 7 rotates, the ribbon winding spool 28 of the tape cassette 20 is rotated to wind a thermal ink ribbon 24. A tape feed roller shaft 8 is vertically arranged at a position to the front and side of the ribbon winding shaft 7 (on the keyboard 4 side). The tape feed roller shaft 8 is driven to rotate by the pulse motor 45 through a suitable transmission mechanism to rotate a tape feed roller 33.

A thermal head 9 is disposed in a fixed position in the cassette accommodation unit 6 to carry out thermal printing to a film tape 22 with use of the thermal ink ribbon 24. The thermal head 9 has 20 heating elements in the direction perpendicular to the feed direction of the film tape 22 and thermal ink ribbon 24.

There is provided an openable accommodation cover 10 for this cassette accommodation unit 6, the accommodation cover 10 being supported at the rear end of the printing device 1. When the accommodation cover 10 is opened, the tape cassette 20 accommodated in the accommodation unit 6 is ejected.

Figure 2:
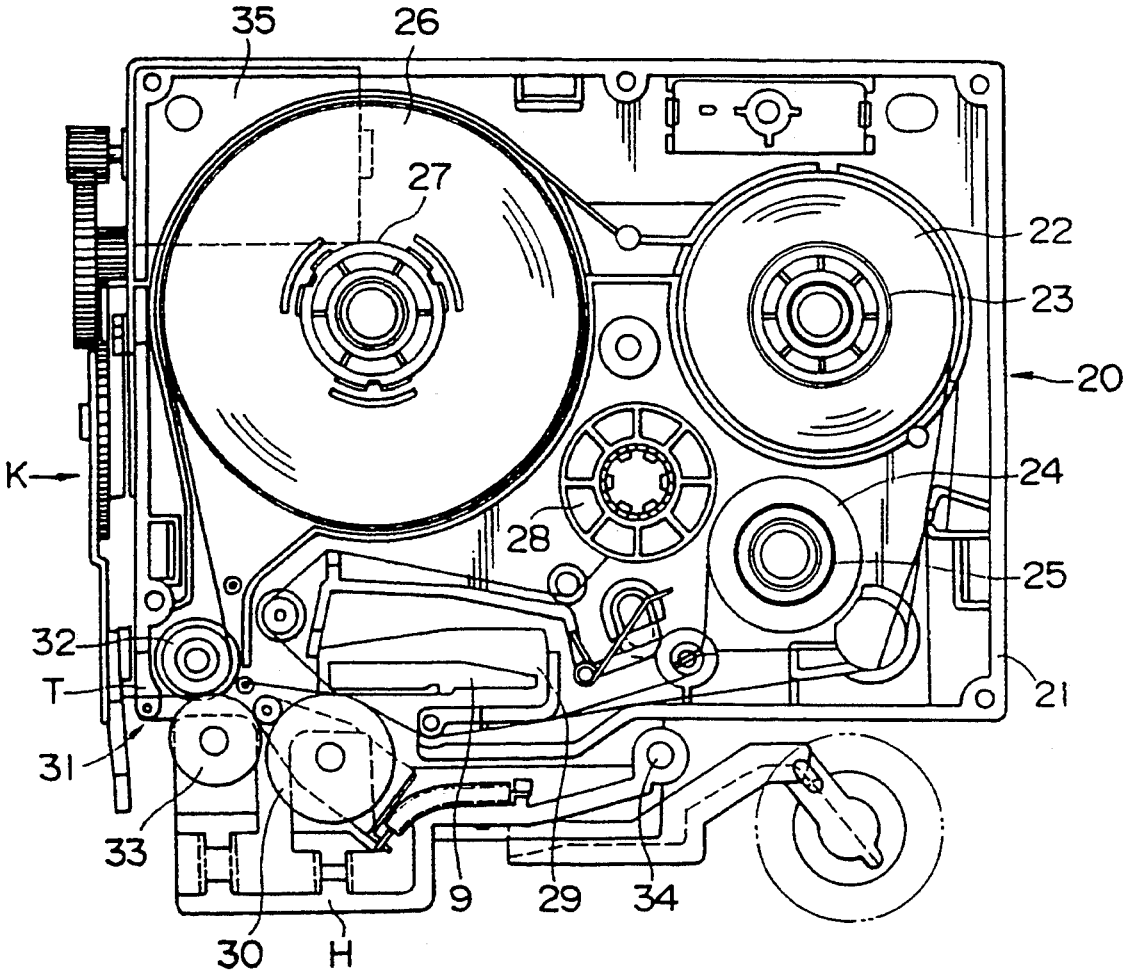
FIG. 2 is a plan view showing a tape cassette the top cover of which is removed.

FIG. 2 is a plan view showing the tape cassette 20 accommodated in the cassette accommodation unit 6, type cassette 20 being shown by removing the top cover thereof.

In the figure, there are disposed on a lower case 21 of the tape cassette 20, a tape spool 23 around which the transparent film tape 22 is wound, a ribbon spool 25 around which the thermal ink ribbon 24 is wound, and an adhesive tape spool 27 around which a double-sided adhesive tape provided with a release paper 26 is wound, a release paper facing the outside. The respective spools 23, 25 and 27 are rotatably supported in association with a support unit disposed on the upper surface of the top cover (not shown).

A ribbon winding spool 28 is rotatably supported on the lower case 21 among the respective spools 23, 25 and 17 in a similar way. The ribbon winding spool 28 is engaged with the aforesaid ribbon winding shaft 7 and winds the thermal ink ribbon 24 used for printing, as driven by the ribbon winding shaft 7.

The thermal head 9 is disposed in the recessed portion 29 of the lower case 21. A platen roller 30 rotatably supported by a roller holder H confronts the thermal head 9 and is biased towards the thermal head 9. The thermal head 9 prints characters such as letters and the like onto the film tape 22 with the use of the thermal ink ribbon 24.

A tape pressing contact roller 32 is rotatably supported in the vicinity of the tape discharge port 31 of the lower case 21 (on the lower left side in FIGS. 1 and 2), and a tape feed roller 33 rotatably supported by the roller holder H is biased toward the tape pressing roller 32.

In the cassette accommodation unit 6, the roller holder H is rotatably supported by a support shaft 34 in front of the tape cassette 20 (on the lower side in FIGS. 1 and 2) and can be switched between a print position and a release position by a manual switch mechanism, not shown (FIG. 2 shows the state that it is switched to the print position).

As shown in FIG. 2, the platen roller 30 and tape feed roller 33 are disposed in the roller holder H in such a manner that they can be rotated, while they are biased towards the thermal head 9 and pressing roller 32, respectively.

Further, a cutter mechanism K is provided along the feeding direction of the film tape 22 in the vicinity of the tape discharge port 31 in the downstream side of the thermal head 9. The cutter mechanism K ha the same arrangement as that of scissors and is composed of a fixed blade (not shown) and a movable blade. The movable blade is driven by a DC motor 35 through a suitable gear mechanism.

Note, the pressing roller 32 associates with the tape feed roller 33 to pressingly adhere the adhesive surface of the double-coated adhesive tape provided with a release paper 26 to the film tape 22 on which characters such as letters and the like are reversely printed by the thermal head 9 with use of the thermal ink ribbon 24. Thus, a tape T is finally prepared.

Figure 3:
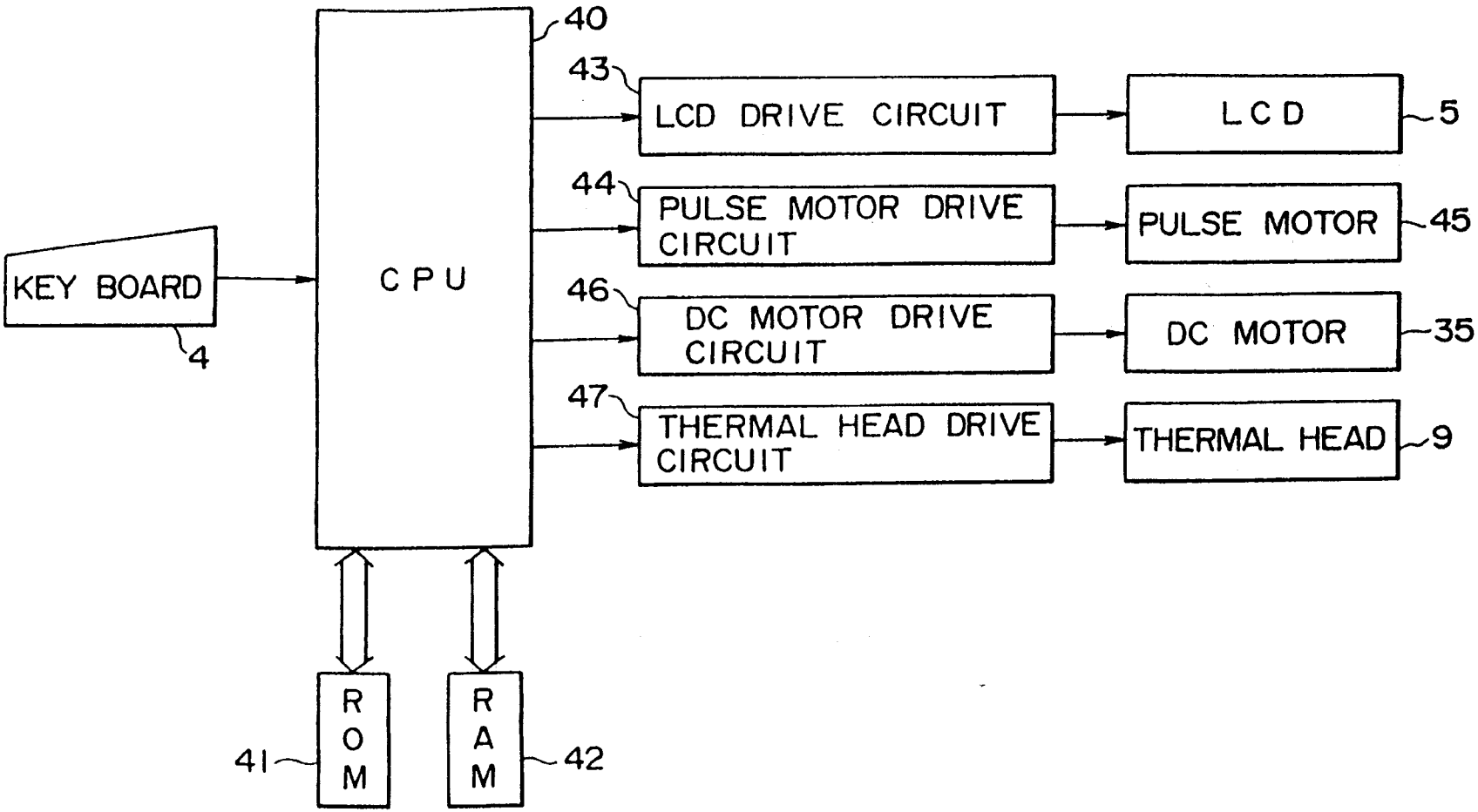
FIG. 3 is a block diagram showing the control system of the printing device.

FIG. 3 is a block diagram of a printing device comprising a CPU (Central Processing Unit) 40 as a control unit. A shown in FIG. 3, the keyboard 4 is connected to the CPU 40 which discriminates character input signals input through the character input keys 2 of the keyboard 4 and various function input signals also input through the function keys such as the print key 3, text creation keys and the like.

Figure 4:
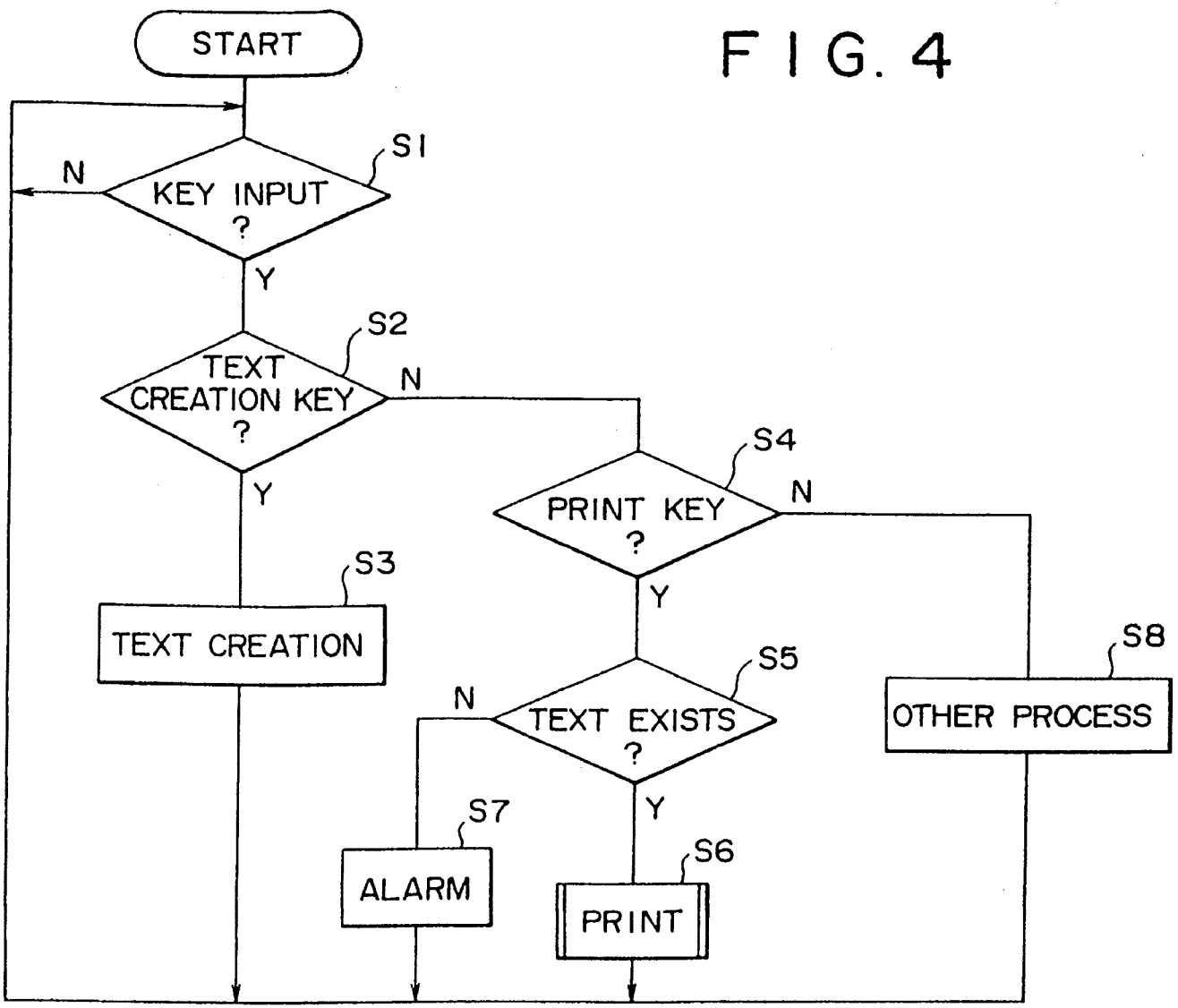
FIG. 4 is a flowchart illustrating a print control program executed by the printing device.
Figure 5:
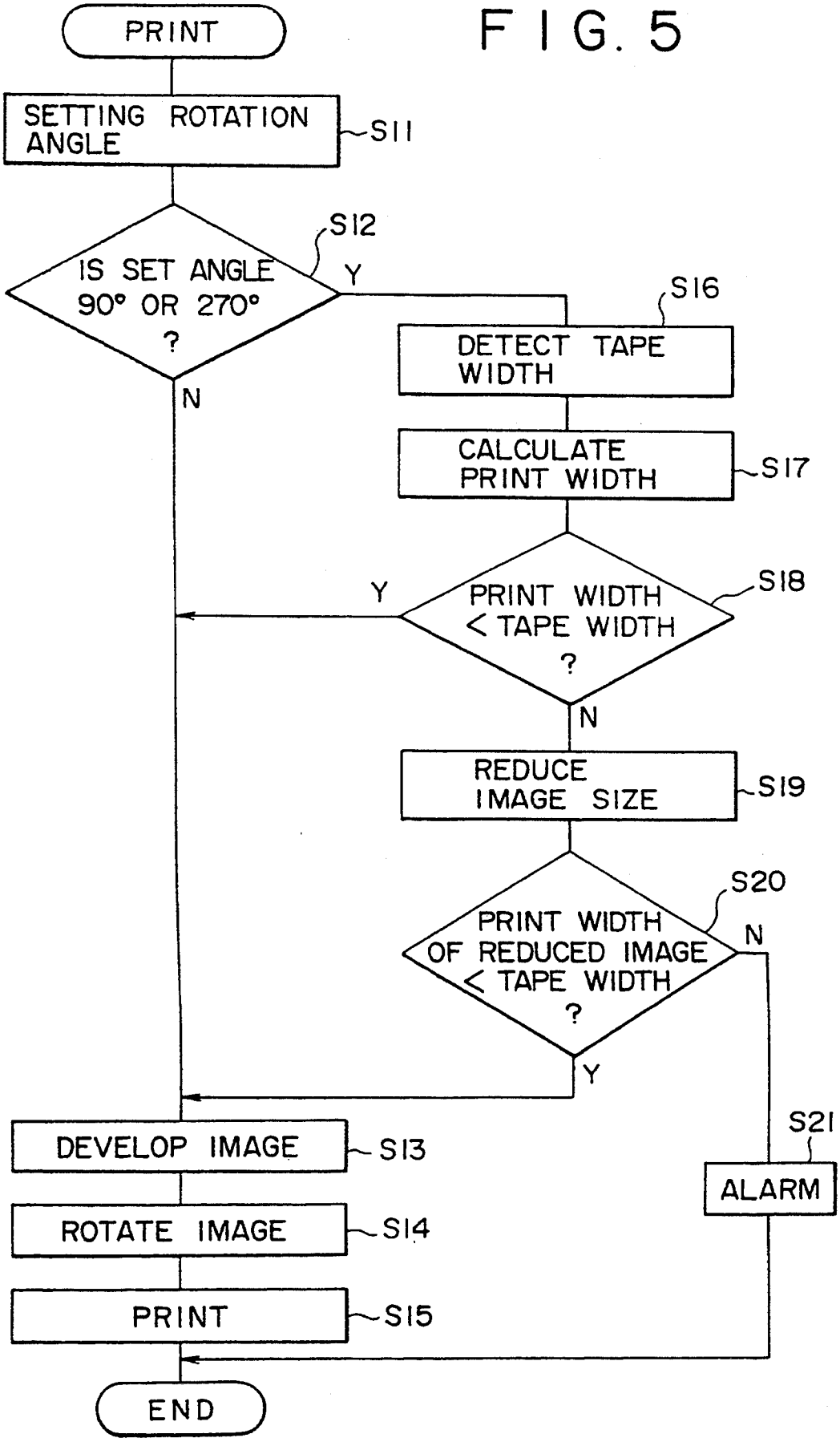
FIG. 5 is a flowchart illustrating a print execution sub-routine.

A ROM 41 is also connected with the CPU 40. A print character generator is incorporated in the ROM 41 to generate character data to be printed by the thermal head 9. In addition, the ROM 41 includes a display character generator for generating character data to be displayed on the liquid crystal display 5. The ROM 41 stores a pulse motor control program for driving the pulse motor 45, and other various programs necessary for controlling the printing device. A print control program illustrated in FIGS. 4 and 5 is also stored in the ROM 41.

A RAM 42 is connected to the CPU 40. The RAM 42 is used for temporarily storing various kinds of data, and includes memories used, for example, as:

a print buffer for storing data read from the above two character generators and developed to print data or display data;

a display buffer; and an auxiliary character pattern buffer for registering auxiliary character pattern data.

The liquid crystal display unit 5 is connected to the CPU 40 through a liquid crystal display drive circuit 43. The CPU 40 drives the liquid crystal display drive circuit 43 in accordance with the display data stored in the display buffer of the RAM 42 to display letters and the like on the liquid crystal display 5.

The CPU 40 drives a pulse motor drive circuit 44 in accordance with the program stored int he ROM 41 to control the pulse motor 45 to control feeding of the tape T synchronously with the printing operation carried out by the thermal head 9.

The CPU 40 also drives a DC motor drive circuit 46 in accordance with the program stored in the ROM 41 to drive the DC motor 35.

The thermal head 9 is connected to the CPU 40 through a thermal head drive circuit 47. The CPU 40 drives the thermal head drive circuit 47 in accordance with the print data stored in the print buffer of the RAM 42 to print letters and the like onto the film tape 22 through the thermal head 9.

Next, a control program of the present invention shown in FIGS. 4 and 5 will be described.

The process in FIG. 4 starts when a key input operation is carried out when the printing device is in its stand-by state. If a key input is executed (step S1), it is discriminated whether the operated key is the text creation key or not (step S2). When it is determined that the text creation key has been operated, text is created (step S3).

When it is decided that the operated key is not the text creation key in step S2, it is discriminated whether the print key is operated or not (step S4). When it is decided that the print key has been operated, it is discriminated whether the text to be printed exists or not (step S5), and if the text exists, printing is carried out (step S6).

When it is determined step S5 that there is no text to be printed an alarm is issued to provide a warning (step S7). When it is determined at step S4 that the operated key is not the print key, other processing is carried out (step S8).

Next, a print execution program shown in FIG. 5 will be described.

First, the printing direction of a character string is set (in Step S11). Then, it is determined whether the set direction of the character string is 90 degrees or 270 degrees (in step S12). In this printing device, the direction of the character string can be selected from four angles, 0 degrees, 90 degrees, 180 degrees, and 270 degrees counter-clockwise.

A method of setting the direction (rotation angle) of the character string in the character string direction setting process will be described.

First, the liquid crystal display 5 displays one of the numerals indicating the four angles "0 degrees", "90 degrees", "180 degrees" and "270 degrees". For example, at first the display 5 displays, "0 degrees". Then, every time the cursor key of the function keys is operated, the displayed number changes in the order: "0 degrees", "90 degrees", "180 degrees", and "270 degrees ". When the return key is operated, the angle shown by the display is set as the printing direction of the character string. In other words, the printing direction of the character string can be set in such a manner that, firstly, the desired angle is displayed by operating the cursor key, and then the return key is operated to select the displayed angle.

When it is discriminated in step 12 that the rotation angle of the character string is not 90 degrees or 270 degrees (i.e., the angle is 0 degrees or 180 degrees), the print information in the text memory is developed to an image (step S13). Next, the image is rotated in accordance with the set direction of the character string (step S14) and printed onto the surface of the tape (step S15).

When it is determined in step 12 that the rotation angle of the character string is 90 degrees or 270 degrees, the tape width is detected (step S16). The detection of the tape width is carried out because the printing device can selectively use two kinds of tape cassettes, a wide tape cassette and narrow tape cassette. Although the reason why these two kinds of the tape cassettes are used is not described here in detail, whether a loaded tape is narrow or wide is detected by a sensor (not shown).

When the tape width is detected in step S15, a print width necessary for printing the print information stored in the text memory is calculated (step S17). Then it is determined whether the calculated print width is smaller than the actual tape width or not (step 18).

When it is determined in step S18 that the calculated print width is smaller than the actual tape width, the process goes to step S13. In step S13, an image is developed, without being reduced, as described above. Then the developed image is rotated in accordance with the set direction (step S14). Then the rotated image is printed onto the tape surface (step S15).

When it is determined in step S18 that the calculated print width is greater than or equal to the tape width, the size of the image corresponding to the print information in the text memory is reduced at a predetermined reduction ratio (80% in this embodiment) in step S19. Then it is determined whether the calculated print width of the reduced image is smaller than the tape width or not (step S20).

When it is determined at step S20 that the calculated print width of the reduced image is smaller than the tape width, the process goes to step S13, and then the print information is developed to an image as described above, rotated in accordance with the set direction (step S14) and printed onto the tape surface as a reduced image (step S15).

Note, when it is discriminated at step S20 that the print width is greater than or equal to the tape width even if the image would be reduced, an alarm is issued to give a warning (step S21). In this case, printing operation is skipped.

Figure 6:
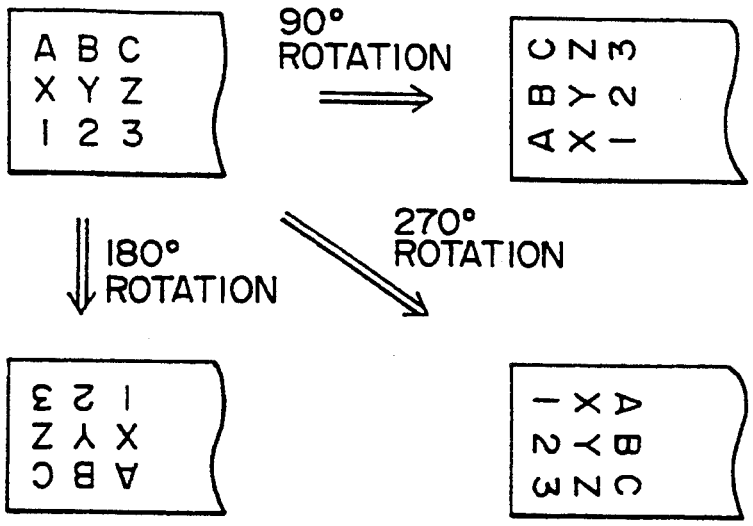
FIG. 6 is a diagram showing a printout on a tape surface by the printing device without changing a magnification ratio.
Figure 7:
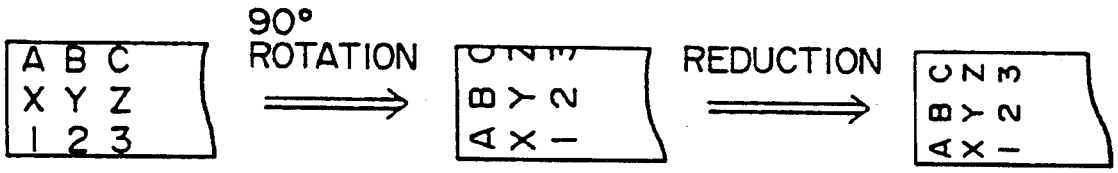
FIG. 7 is a diagram showing a printout on the tape surface, having different magnification ratios.
Figure 8:
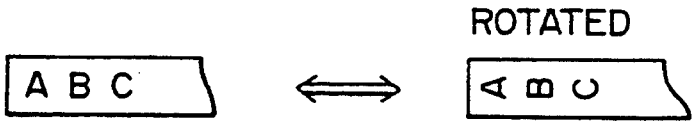
FIG. 8 is a diagram explaining an example in which a character string is printed with each character of the string is rotated.
Figure 9:
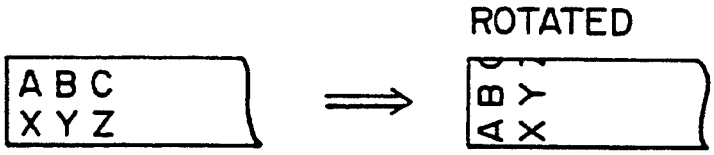
FIG. 9 shows a deficiency in a prior art.

FIGS. 6 and 7 shows how the print information is printed onto the tape surface by the printing device. In FIG. 6, the print information is printed by only changing the printing direction without changing the size thereof. While in FIG. 7, the print information should be reduced when printed in the rotated fashion.

According to the present invention described with reference to the aforesaid embodiment, a character string can be printed in the longitudinal direction or lateral direction on a tape surface. Further, if the character string printed in the tape width direction overflows the tape width when printed in the width direction, printing is carried out by reducing the size of characters, and thus the print information can usually be contained within the tape width.

As apparent from the above description, according to the printing device of the present invention, the print information of a character string and the like to be printed onto a tape surface is suitably printed in the longitudinal direction or across the width direction on the tape surface. Further, when a character strings to be printed across the tape width with a normal character size are smaller than the tape width, the character strings are printed with a predetermined reduced size so that the character strings can be contained within the tape width. Therefore, the printing device according to the present invention satisfies the needs of a user and is very convenient for use.

What is claimed is:

1. A printing device capable of printing an image onto a tape-type recording medium along the longitudinal direction of said tape-type recording medium, comprising:

means for printing said image on said tape-type recording medium in a rotated fashion with respect to said longitudinal direction;

means for detecting a width of said tape-type recording medium;

means for detecting the length of the image to be printed and for comparing said length with the width of said tape-type recording medium;

means for reducing a size of said image to be printed on said tape-type recording medium in said rotated fashion if the length of the image to be printed is greater than the width of the tape-type recording medium;

second means for detecting a reduced length of the image to be printed after reducing the size of said image to be printed; and means for rotating said image with respect to said longitudinal direction if the width of the tape-type recording medium is greater than the reduced length of the image to be printed.

2. The printing device according to claim 1, wherein said image comprises a character string having a plurality of characters.

3. The printing device according to claim 1, wherein said image comprises a plurality of lines of character string each having a plurality of characters.

4. The printing device according to claim 1, further comprising means for setting an angle, said printing means being capable of printing said image with rotation at said set angle.

5. The printing device according to claim 4, said setting means comprises select means for selecting one angle among a plurality of predetermined angles.

6. The printing device according to claim 5, wherein said plurality of predetermined angles comprises angles of 90 degrees and 270 degrees counter-clockwise.

7. A printing device capable of printing an image onto a tape-type recording medium along the longitudinal direction of said tape-type recording medium, comprising:

means for printing said image on said tape-type recording medium in a rotated fashion with respect to said longitudinal direction of said tape-type recording medium;

means for determining whether a length of said image to be printed in rotated fashion is smaller than the width of said tape-type recording medium when said image is rotated to be printed in the width direction of said tape-type recording medium;

means for reducing said size of said image if it is determined that said length of said image is greater than or equal to said width of said tape-type recording medium;

second determining means for determining whether the length, in the width direction of said tape-type recording medium, of the image to be printed after reduction by said reducing means is smaller than said width of said tape-type recording medium; and alarm means actuated if it is determined that said length of the reduced image is greater or equal to said width of said tape-type recording medium.

8. The printing device according to claim 7, wherein said printing means prints said image without reducing the size thereof if it is determined that said length of said image is smaller than said width of said tape-type recording medium.

9. The printing device according to claim 7, wherein said image comprises a character string having a plurality of characters.

10. The printing device according to claim 7, wherein said image comprises a plurality of lines of character strings each having a plurality of characters.

11. The printing device according to claim 7, further comprises means for prohibiting printing operation if it is determined that said length of the reduced image is greater than or equal to said width of said tape-type recording medium.

12. The printing device according to claim 7, further comprising means for setting an angle, said printing means being capable of printing said image with rotation at said set angle.

13. The printing device according to claim 12, said setting means comprises select means for selecting one angle among a plurality of predetermined angles.

14. The printing device according to claim 13, wherein said plurality of predetermined angles comprises angles of 90 degrees and 270 degrees counter-clockwise.

15. The printing device according to claim 14, wherein said plurality of predetermined angles further comprises an angle of 180 degrees, and wherein said printing means merely prints said image with a 180-degree rotation.

16. A printing device capable of printing an image onto a tape-type recording medium along the longitudinal direction of said tape-type recording medium, comprising:

means for printing said image on said tape-type recording medium in a rotated fashion with respect to said longitudinal direction of said tape-type recording medium;

means for determining whether a length of said image to be printed in rotated fashion is smaller than the width of said tape-type recording medium when said image is rotated to be printed in the width direction of said tape-type recording medium;

means for reducing said size of said image if it is determined that said length of said image is greater than or equal said width of said tape-type recording medium;

second determining means for determining whether the length, in the width direction of said tape-type recording medium, of the image to be printed after reduction by said reducing means is smaller than said width of said tape-type recording medium; and means for prohibiting said printing operation if it is determined that said length of said reduced image is greater than or equal to said width of said tape-type recording medium.

* * * * *